US005794319A

United States Patent [19]

Hunziker

[11] Patent Number: 5,794,319

[45] Date of Patent: Aug. 18, 1998

[54] METHOD AND DEVICE FOR DRAWING-IN AND TRANSPORTING WARP THREADS

[75] Inventor: Martin Hunziker, Maienfeld, Switzerland

[73] Assignee: Staubli AG, Sargans, Switzerland

[21] Appl. No.: 770,896

[22] Filed: Dec. 20, 1996

[30] Foreign Application Priority Data

Dec. 21, 1995 [CH] Switzerland ..... 03624/95

[51] Int. Cl.[6] ..... D03J 1/14

[52] U.S. Cl. ..... 28/203.1; 28/202; 28/204

[58] Field of Search ..... 28/204, 202, 203.1, 28/208

[56] References Cited

U.S. PATENT DOCUMENTS

| | | | |
|---|---|---|---|
| 3,787,938 | 1/1974 | Crandall et al. . | |
| 4,014,083 | 3/1977 | Heinz . | |
| 4,878,279 | 11/1989 | Tachibana et al. | 28/203.1 |
| 5,136,762 | 8/1992 | Gironi . | |
| 5,243,742 | 9/1993 | Nishimura et al. | 28/202 |
| 5,287,605 | 2/1994 | Badertscher et al. . | |
| 5,355,566 | 10/1994 | Eglseer et al. . | |

FOREIGN PATENT DOCUMENTS

| | | | |
|---|---|---|---|
| 680 076 | 6/1992 | Switzerland . | |
| 682577 | 10/1993 | Switzerland | 28/203.1 |
| WO 92/05303 | 9/1991 | WIPO | 28/203.1 |
| 92/08830 | 5/1992 | WIPO . | |

*Primary Examiner*—Andy Falik

*Attorney, Agent, or Firm*—Burns, Doane, Swecker & Mathis, L.L.P.

[57] ABSTRACT

A method and a device for drawing warp threads into harness elements of a weaving machine through use of a drawing-in member which effects a reciprocating movement and with at least one conveying device for harness elements. In order to increase the capacity of devices of this type, the drawing-in member is constructed to carry out a reciprocating movement which is short compared with the length of the warp threads. This is done by providing a transporting device that transports the warp thread to a point in front of a weaving reed.

17 Claims, 1 Drawing Sheet

METHOD AND DEVICE FOR DRAWING-IN AND TRANSPORTING WARP THREADS

FIELD OF THE INVENTION

The invention relates to the drawing-in of warp threads, and more particularly to a method and a device for drawing warp threads into harness elements of a weaving machine with a drawing-in member.

BACKGROUND OF THE INVENTION

A method and a device for drawing-in warp threads are known, for example, from CH 682 577 and PCT/CH91/00190. The illustrated device comprises a needle-shaped drawing-in member, which, from a starting position behind the weaving reed, is moved a long distance towards the warp thread layer where it takes up a warp thread. On its return path, the drawing-in member pulls a warp thread through a plate, a heald and the weaving reed. By virtue of this arrangement, it is necessary that the drawing-in member cover large intermediate spaces between the warp thread layer and the plate, the plate and the heald, and the heald and the weaving reed. Arranged in these intermediate spaces are special guide elements for the laterally flexible drawing-in member. Provided in the intermediate spaces are modules for making ready empty healds and plates, and for distributing healds and plates provided with warp threads. The modules can comprise, for example, rotating driving elements.

If high drawing-in capacities are to be obtained using this known device, it is necessary to displace the drawing-in member at a high velocity. However, this means increased wear to the drawing-in member in the long guide elements and increased danger of the thread jamming as it is guided through the harness elements or breaking as a consequence.

SUMMARY OF THE INVENTION

In light of the foregoing, a need exists for a drawing-in device which allows for high drawing-in velocities without the known, associated disadvantages.

This object is attained in that the warp threads are no longer collected from a remote location by the drawing-in member, but are brought by a transportation device to a transfer site where they are collected by the drawing-in member. The transfer site is located as close as possible to the weaving reed and the paths of movement of the harness elements such as healds and plates are also close to the weaving reed that the drawing-in member, for example a drawing-in needle, only needs to effect a relatively short reciprocating movement in order to pass through all the harness elements. In other words, the distance which lies, for example, between the warp thread layer with the set-up warp threads and the weaving reed only needs to be partially covered by the drawing-in member. The rest of the distance is bridged by a transportation device, which preferably draws the warp threads in a staggered fashion from the warp thread layer towards the drawing-in member.

The paths of movement of the harness elements are preferably effected within a space measuring approx. 60 to 100 mm in width, so that the distance or stroke of the drawing-in member can be restricted to a length of 120 to 200 mm, which is also dependent upon the length of the loop which the warp thread forms in order to suspend itself in the drawing-in member.

The advantages attained in this manner are that the drawing-in member only needs to effect a reciprocating movement which is relatively short compared with the warp thread length or the distances between the harness elements conventionally used in weaving machines, and can therefore also effect this movement at a slower speed. Problems of wear are thereby ruled out and the risk of warp threads not being guided over the entire length is considerably reduced. As a result of the short reciprocating movement, the entire drive for the drawing-in member is simplified, so that said drive can be constructed at a reduced cost. If the transportation device is constructed in such a manner that it transports a plurality of warp threads simultaneously, but releases the threads simultaneously in staggered fashion to the drawing-in member, then the warp threads also cover this distance at a slower speed. The drawing-in capacity nevertheless remains high.

According to the present invention, the method for drawing warp threads into harness elements of a weaving machine through use of a drawing-in member involves conveying the warp threads individually with a first movement to a transfer site immediately in front of a weaving reed, individually grasping the warp threads with a drawing-in member, and drawing the individual warp threads with a second movement into the harness elements through movement of the drawing-in member.

A device for drawing warp threads into harness elements of a wearing machine in accordance with the present invention includes a drawing-in member that is able to move in a reciprocating manner, and a transportation device which supplies the warp threads to the drawing-in member by transporting the warp threads to the drawing-in member substantially in the direction of reciprocating movement of the drawing-in member

BRIEF DESCRIPTION OF THE DRAWING FIGURES

Further features and details of the invention will become more apparent from the following description of the present invention considered in conjunction with the accompanying drawing FIGURE in which FIG. 1 is a perspective view of a portion of a drawing-in machine in accordance with the present invention.

DETAILED DESCRIPTION OF THE INVENTION

Figure 1:
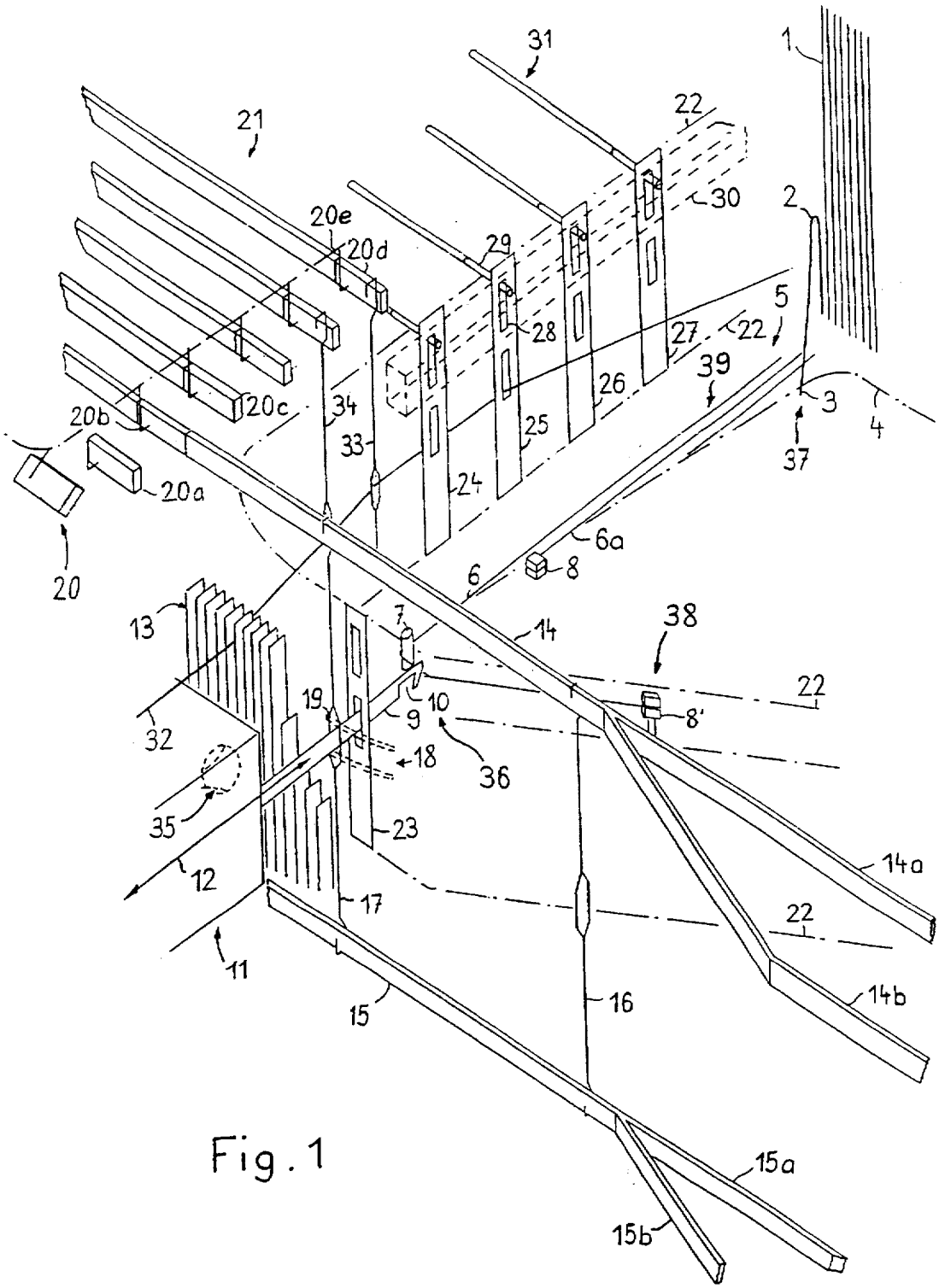

FIG. 1 shows warp threads, in this case not shown over their entire length, which are set up in known manner in a frame to form a warp thread layer 1. A warp thread 2 from this warp thread layer 1 is located with its end 3 in the region of the path of movement 4 of several transportation clamps 8, 8' forming a transportation device 5. In this way, the end 3 of the warp thread 2 can be grasped by one of the transportation clamps.

A presentation device for moving the warp thread 2 from a position in the plane of the warp layer 1 to the presentation position shown in the drawing FIGURE is known, for example, from WO 92/08830 and its U.S. counterpart, U.S. Pat. No. 5,355,566 (the entire disclosure of which is incorporated herein by reference). This presentation device is generally arranged vertically, by means of which the end 3 of the warp thread can be brought into the illustrated position. In the known system, the presentation device was employed to move the end 3 of the warp thread 2 to the presentation position where it could be grasped by the drawing-in member.

The transportation device 5 of the present invention that is utilized to transport the end 3 of the warp thread 2 from the illustrated position at the warp layer 1 to a position immediately in front of the weaving reed 13 can be designed in a manner similar to the presentation device disclosed in WO 92/08830 and its U.S. counterpart, U.S. Pat. No. 5,355,566. However, the transportation device is arranged substantially horizontal, or is to be arranged in the plane of the reciprocating movement of the drawing-in member 9.

The transportation device 5 is constructed in such a manner that it pulls warp threads, such as a warp thread 6 for example, around a reversing pin 7 and then releases the thread in a given position. The transportation device 5 essentially comprises a rotating member, such as a chain, with clamping members 8, 8' secured to the chain. In order to open and close the clamping members 8, 8', sliding blocks or cam rails known per se but not illustrated are, for example, provided in the region of take-up and release sites 37, 38.

In the illustrated position, the warp thread 6 is prepared at a transfer site 36 in such a manner that it forms a loop and can be grasped by a drawing-in member 9. To this end, the drawing-in member 9 needs to be moved somewhat further from the illustrated position towards the warp thread 6, so that the thread jumps into the recess 10. The return stroke of the drawing-in member 9 can then begin. A drive 11, which can be constructed for example as a crank drive or as a linear motor, etc., is operatively associated with the drawing-in member 9 to effect movement of the drawing-in member. The reciprocating movement of the drawing-in member 9 is indicated by an arrow 12. Located at a short distance in front of the drive 11 is a weaving reed 13 known per se, which is also constructed as a harness element in this case.

Guide rails 14 and 15 are arranged in a plane located a short distance from the weaving reed 13. The guide rails 14, 15 act as upper and lower guides for harness elements, more particularly in this case healds 16, 17. Since the healds 16, 17 can be of different construction, they are prepared separately in a manner known per se in accordance with their design on separate guide rails 14*a*, 14*b* and 15*a*, 15*b*. The healds move into the position depicted as heald 17 by means of conveying devices that are also known per se. Since the healds are very flexible and movable, it is possible to ensure by means of a locally arranged guide 18 that the eyelet 19 is aligned in such a manner that it forms a passage for the drawing-in member 9 and can receive a warp thread. The healds with the drawn-in warp threads are advanced and transferred to a rotating distribution member 20 which, for example comprises short sections 20*a*, 20*b*, 20*c* etc. of guide rails, which are arranged in spaced apart relation, for example on a rotating chain, the distances apart corresponding to the spacing of shafts 21. The rotating chain is illustrated in the drawing by way of example by the dot-dash line 20*e*. The drive of the distribution member 20 is effected cyclically, so that there is always time available in which the healds can be transferred to the shafts 21. A conveyor belt can undertake the transfer in question in place of the illustrated distribution member 20.

Devices known per se can be used for transporting the healds from the sections 20*a*–20*d* to the individual shafts. A further distribution member, not shown in further detail here, is arranged at the bottom for guiding the healds and is constructed in precisely the same manner as the distribution member 20 and is also moved synchronously therewith. The two distribution members 20 thus move substantially in a vertical plane relative to the shafts 21.

A path of movement for further harness elements, such as the plates, is indicated by dot-dash lines 22, extending at a short distance from the plane 14, 15 and also intersecting the reciprocating movement 12 of the drawing-in member 9. A plurality of plates 23, 24, 25, 26 and 27 are shown here in different positions along this path of movement 22. In this respect, the plate 23 is located in a drawing-in position for the warp threads 6. The plates 23–27 each comprise a transportation aperture, as indicated by reference numeral 28 on the plate 25. This aperture is adapted to receive a carrier 29 which carries the plate 25 along the path of movement 22. Carriers 29 of this type are secured in a manner known per se, for example to a conveying device, such as a rotating chain, which rotates and is guided in a duct 30, only partly shown in the drawing. In the illustrated position of the plates 24–27, the plates are positioned to be transferred to the plate carriers 31. A conveying device of this type is already known, for example, from PCT/CH91/00190, although with a path of movement having a different course.

Although the drawing shows only a single drawn-in warp thread 32 which is drawn through the weaving reed 13, the heald 33 and the plate 25, it should be assumed that the heald 34 and the plates 24, 26 and 27 also comprise a drawn-in warp thread, which is also drawn into the weaving reed 13. The drawing is merely shown in this form for the purpose of simplification. Insofar as the method of operation is not already known, it will be summarized again briefly below.

One warp thread after the other is presented from the warp thread layer 1 in such a manner that an end 3 of the warp thread moves into the path of movement 4 of the clamps 8 of the transportation device 5, whereby the warp thread is pulled in a first movement into the position of the warp thread 6. This occurs at a first, relatively slow velocity, which is made possible in that the following warp thread 6*a* is already grasped by the transportation device 5 as a result of the staggered transportation, before the preceding warp thread 6 reaches the transfer site 36. Together, the staggered warp threads form a plane 39, which extends approximately parallel to the reciprocating movement 12 of the drawing-in member and preferably horizontally.

At the same time, harness elements are prepared, for example a heald 17 and a plate 23 in the illustrated position and the weaving reed 13 with the next aperture, into which a warp thread has not yet been drawn. To this end, the harness elements which are provided for drawing-in comprise movement paths 22, which intersect the reciprocating movement of the drawing-in member. The movement paths extend immediately adjacent and at least approximately parallel one another in the region of the drawing-in member 9. For the drawing-in operation, the harness elements 13, 17, 23 remain in position so that the drawing-in member 9 can carry out the reciprocating movement 12 engaging through the harness elements. In this manner, the warp thread 6 is drawn-in with a second movement and is transferred to the subsequent securing element 35, which secures the warp thread 6 and can be formed, for example, by a suction nozzle. This second movement is carried out at a velocity which is preferably a multiple greater than the first velocity of the warp thread in the transportation device 5. In order to allow for rapid, problem-free drawing-in, the movement paths of the harness elements, i.e. the lateral movement of the weaving reed 13, the lateral movement of the healds 16, 17 in the plane 14, 15 and the lateral movement of the plate 23 along the lines 22, extend parallel, immediately adjacent and as close as possible to one another. This is particularly the case at the location where the lines 22 intersect the reciprocating movement 12 of the drawing-in member 9.

Subsequently, the harness elements are advanced and brought to the distribution stage, which can be effected cyclically, for example, in synchronism with the drawing-in member 9. The healds are supplied by means of the rotating distribution member 20 to the shafts 21 and are distributed in an orderly fashion to individual shafts. To this end, the healds remain on the distribution member 20 for different periods of time or for a different number of cycle times. The control of this distribution is known per se and is therefore not illustrated in further detail here. The plates 24–27 which are advanced by the known conveying device along the path of movement 22 are also released in a known manner to the plate carriers 31. As a result of these movements, relative movement is produced between the drawn-in warp threads 32 and the harness elements, so that the healds and plates, for example, slide along the warp thread 32, namely in the opposite direction to the drawing-in movement. However, this can occur without problems and without damaging the warp thread as a result of the fact that the movements are effected slowly.

The principles, preferred embodiments and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A method for drawing warp threads into harness elements of a weaving machine through use of a drawing-in member, comprising conveying the warp threads individually with a first movement to a transfer site immediately in front of a weaving reed, individually grouping the warp threads with a drawing-in member, and drawing the individual warp threads with a second movement into the harness elements.

2. A method according to claim 1, wherein the second movement is carried out at a velocity which is a multiple greater than the velocity of the first movement.

3. A method according to claim 1, wherein the step of conveying the warp threads includes conveying the warp threads so that they reach the transfer site in the first movement in a staggered fashion, with the staggered warp threads forming a plane which extends substantially parallel to the second movement of the drawing-in member.

4. A method according to claim 1, including conveying the harness elements individually into a space between the transfer site and the weaving reed.

5. A method according to claim 1, wherein the harness elements include healds and plates, and including moving the healds and the plates after the warp threads are drawn-in to a stage for distribution onto shafts and plate carriers respectively, the plates and healds being moved in the opposite direction to the second movement of the warp thread during the drawing-in.

6. A device according to claim 5, wherein the harness elements are movable along paths of movement which intersect the reciprocating movement of the drawing-in member at a point of intersection, and at the point of intersection the paths of movement extend immediately adjacent and substantially parallel to one another.

7. A device according to claim 6, wherein the transportation device is constructed to effect simultaneous staggered transportation of a plurality of warp threads.

8. A device according to claim 5, wherein the transportation device comprises clamps movable along a movement path.

9. A device for drawing warp threads into harness elements of a weaving machine, comprising a drawing-in member for moving in a reciprocating manner, and a transportation device for transporting the warp threads to the drawing-in member by transporting the warp threads substantially in the direction of reciprocating movement of the drawing-in member to a position in front of a weaving reed.

10. A method for drawing-in a warp thread into harness elements, comprising:

transporting a warp thread from a warp thread layer to a drawing-in position immediately in front of a weaving reed;

grasping the warp thread in the drawing-in position with a drawing-in member;

drawing the warp thread into the harness elements by moving the drawing-in member through the harness elements with the warp thread grasped by the drawing-in member.

11. A method according to claim 10, wherein the step of transporting the warp thread includes grasping an end of the warp thread with a clamp and moving the clamp which is grasping the end of the warp thread to the drawing-in position.

12. A method according to claim 10, wherein the warp thread is transported around a reversing pin.

13. A method according to claim 10, including transporting a plurality of warp threads in a staggered manner.

14. A method for drawing-in a warp thread into harness elements, comprising:

transporting a warp thread from a warp thread layer around a reversing pin and to a drawing-in position;

grasping the warp thread in the drawing-in position with a drawing-in member;

drawing the warp thread into the harness elements by moving the drawing-in member through the harness elements with the warp thread grasped by the drawing-in member.

15. A method according to claim 14, including transporting a plurality of warp threads in a staggered manner.

16. A method according to claim 14, wherein the step of transporting the warp thread includes grasping an end of the warp thread with a clamp and moving the clamp which is grasping the end of the warp thread to the drawing-in position.

17. A method according to claim 14, wherein the step of transporting includes transporting the warp thread to a position immediately in front of a weaving reed.

* * * * *